US006332221B1

(12) United States Patent
Gracey

(10) Patent No.: US 6,332,221 B1
(45) **Date of Patent: *Dec. 25, 2001**

(54) THERMOREGULATORY CLOTHING

(76) Inventor: Nicholas Dynes Gracey, 35 Lyons Lane Appleton, Warrington Cheshire WA4 5JH (GB)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 07/916,072

(22) PCT Filed: Dec. 28, 1990

(86) PCT No.: PCT/GB90/02037

§ 371 Date: Oct. 21, 1993

§ 102(e) Date: Oct. 21, 1993

(87) PCT Pub. No.: WO91/09544

PCT Pub. Date: Jul. 11, 1991

(30) Foreign Application Priority Data

Dec. 28, 1989 (GB) ..... 8929369

(51) Int. Cl.[7] ..... A41D 1/02; A41D 1/06

(52) U.S. Cl. ..... 2/69; 2/79; 2/115; 2/227; 2/108; 2/DIG. 1

(58) Field of Search ..... 2/69, 81, 115, 2/DIG. 1, 79, 458, 467, 93, 108, 87, 227, 77

(56) References Cited

U.S. PATENT DOCUMENTS

| | | | | |
|---|---|---|---|---|
| 179,661 | * | 7/1876 | Lee | 2/DIG. 1 |
| 308,244 | * | 11/1884 | Fishel | 2/DIG. 1 |
| 1,252,187 | * | 1/1918 | Shane | 2/DIG. 1 |
| 2,391,535 | * | 12/1945 | Zelano | 2/DIG. 1 |
| 2,715,226 | * | 8/1955 | Weiner | 2/DIG. 1 |
| 3,045,243 | * | 7/1962 | Lash et al. | 2/DIG. 1 |
| 3,710,395 | * | 1/1973 | Spano et al. | 2/81 |
| 3,761,962 | * | 10/1973 | Myers | 2/79 |
| 4,126,903 | * | 11/1978 | Horton | 2/DIG. 1 |
| 4,185,327 | * | 1/1980 | Markve | 2/69 |
| 4,195,364 | * | 4/1980 | Bengtsson et al. | 2/81 |
| 4,513,451 | * | 4/1985 | Brown | 2/69 |
| 4,608,715 | * | 9/1986 | Miller et al. | 2/DIG. 1 |
| 4,619,004 | * | 10/1986 | Won | 2/DIG. 1 |
| 4,722,099 | * | 2/1988 | Kratz | 2/79 |
| 4,804,351 | * | 2/1989 | Raml et al. | 2/DIG. 1 |
| 5,033,118 | * | 7/1991 | Lincoln | 2/115 |
| 5,105,478 | * | 4/1992 | Pyc | 2/115 |
| 5,282,277 | * | 2/1994 | Onozawa | 2/69 |

FOREIGN PATENT DOCUMENTS

| | | | | |
|---|---|---|---|---|
| 1435981 | * | 3/1969 | (DE) | 2/DIG. 1 |
| 2702407 | * | 7/1978 | (DE) | 2/DIG. 1 |
| 2108822 | * | 5/1983 | (GB) | 2/DIG. 1 |
| 2193429 | * | 2/1988 | (GB) | 2/DIG. 1 |
| 198705 | * | 7/1960 | (SE) | 2/DIG. 1 |

* cited by examiner

*Primary Examiner*—Amy B. Vanatta

(57) ABSTRACT

It is an object of the present invention to provide a means by which clothing may be made more effective in its role in assisting temperature regulation, by: 1) providing increased heat exchange by means of reduced insulation (herein defined as "lower insulatory capacity") of temperature sensitive sites (11, 16, 14)—reducing insulation of temperature sensitive areas not protected by "fat pads"; and/or 2) providing for increased vapor exchange by means of specific ventilation of temperature sensitive areas (herein defined as "increased ventilatory capacity")—allowing flexibility for rapid increases in heat generation owing to facility for improved vapor exchange e.g. the loss of excess heated air or humidity, by, for example, convection and evaporation of sweat from the surface of the skin.

12 Claims, 7 Drawing Sheets

29

29

29

29

29
30

29
30

29
30

29
30

30

30

31

31

31

31
30

31
30

31
30

31
30

31
30

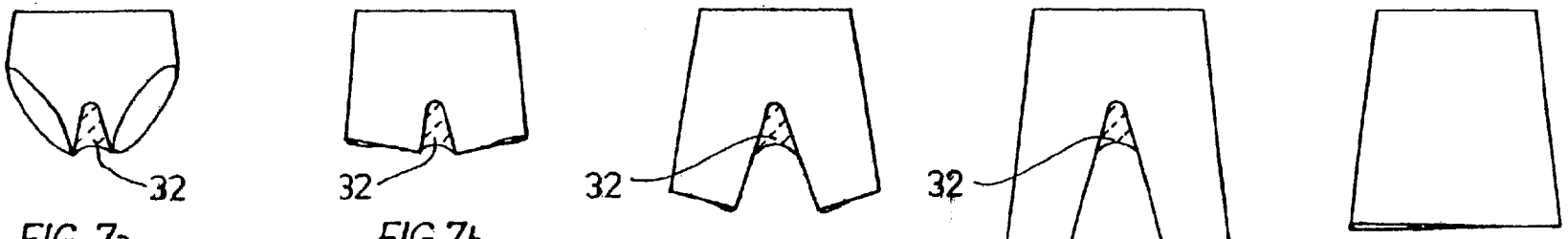
FIG.7a FIG.7b FIG.7c FIG.7d FIG.7e
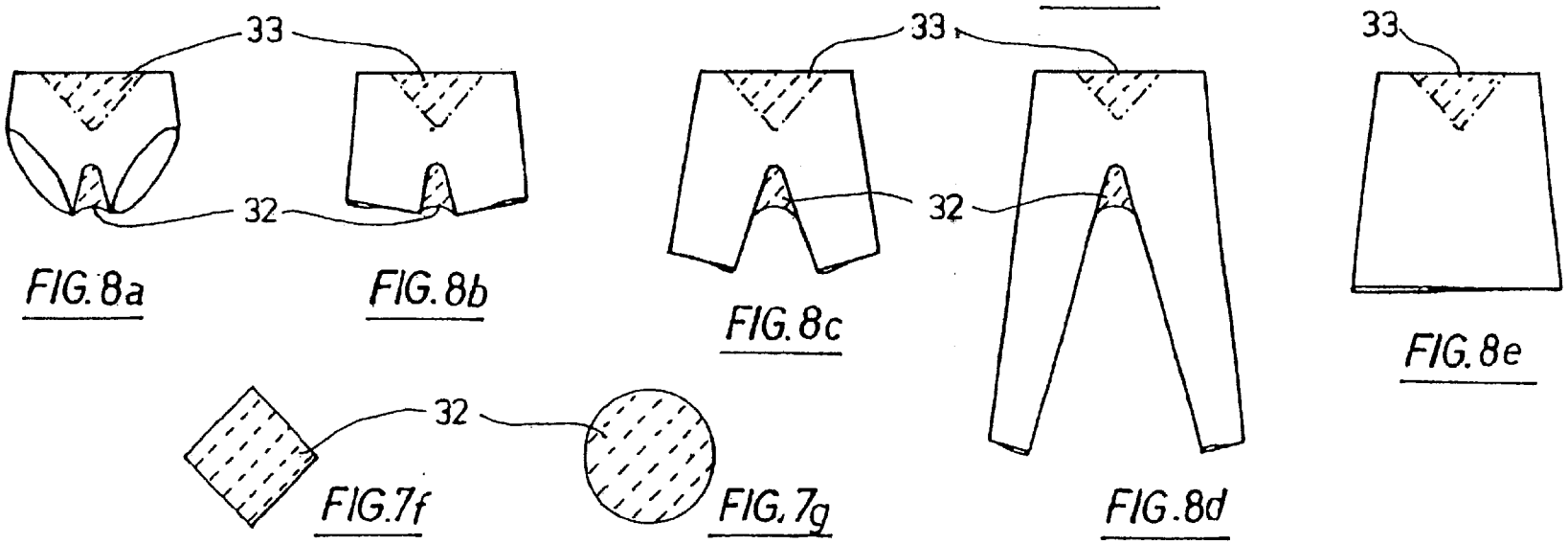
FIG.8a FIG.8b FIG.8c FIG.8d FIG.8e
FIG.7f FIG.7g

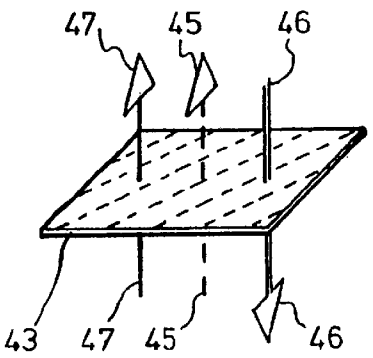
FIG.11
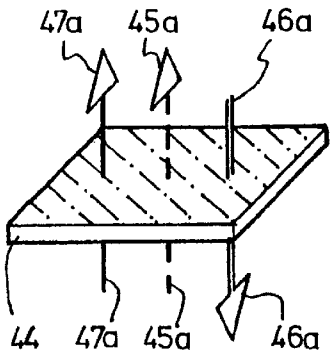
FIG.12
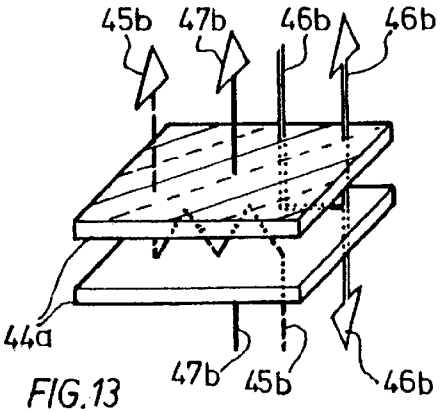
FIG.13
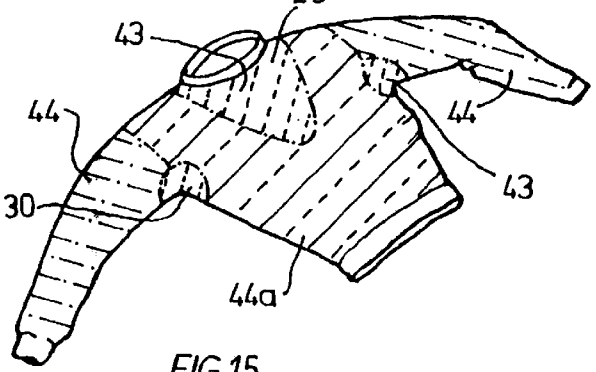
FIG.14
FIG.15

THERMOREGULATORY CLOTHING

BACKGROUND OF THE INVENTION

I. Field of the Invention

This invention relates to the thermoregulatory nature of articles of clothing.

One function of clothing is to provide humans with a means of maintaining body temperature between limits which are both comfortable and necessary for normal body function.

The human body possesses a tissue known as adipose tissue or fat, of which there are two recognized types; 'Yellow or White Fat' and 'Brown Fat'. Each characterized by; structure, localization, vascularisation and function of the cells.

White fat has a great capacity to insulate the body from heat loss, thereby assisting temperature regulation. White fat cells are found over the entire human body, the general anatomical distribution of which is characteristic to humans.

Brown fat is a tissue capable of metabolism which actively generates heat, thereby assisting temperature regulation. Brown fat cells are found in localized areas over the human body, the general anatomical distribution of which is characteristic of humans.

It is recognized that active brown fat possesses the ability to generate heat in response to cold stress, and of all tissues it is believed to have the greatest capacity for heat production.

Relatively high densities of brown fat cells, and relatively high densities of white fat cells (the latter being hereinafter defined as 'fat pads') are located over the body; Where these coincide the white fat cells are theoretically providing insulation/lagging for any increased cellular heat production in this area.

As well as generating heat, and insulating in order to conserve increased internal heat produced, the body also controls temperature (hereinafter defined as 'thermoregulates') by redistribution of blood flow to the skin's surface; decreasing this flow to insulate or build up internal heat, and increasing this flow to cool down. Sweating may also occur if the body's requirements for heat loss are even greater.

Certain specific areas of the skin (hereinafter defined as areas 'over the body') appear to be particularly sensitive to their (immediate) environmental climate (hereinafter defined as 'microclimate'), and in particular the temperature of the microclimate. In the case of a clothed human being, the environment between the skin and the clothing would be the microclimate. Specific areas of the body which are particularly sensitive to their microclimate are hereinafter defined as 'temperature sensitive sites'.

The skin is covered with millions of tiny temperature sensors, which tell the body how hot or cold it is outside. Messages are then passed from the sensors to the main control center, (the hypothalamus) located in the brain, which will in turn direct the body either to force up its internal heat generation (hereinafter defined as 'metabolism'), increasing the conversion of the body's fuel into heat, thereby increasing its temperature, if it is cold, or drive down its metabolism and temperature, if it is hot.

It matters little that there might be ice and snow outside as the microclimate between the skin and clothing may well be warm or even hot, and it is this microclimate which will affect the temperature sensors and not the cold conditions outside.

The spine is the brain's chief temperature sensor, and therefore, the brain will tend to follow the messages sent from the spine's temperature sensors, above those from other areas of the skin.

So, if the microclimate of the spine is cool, the nerves are stimulated in this region, sending messages to the brain to increase metabolism. This means that everything including the immune system, will be working harder.

If, however, the microclimate of the spine is either (i) too warm, resulting in a lack of nerve stimulation, or (ii) too hot; resulting in heated nervous stimulation, which continues to stimulate metabolism but maintains an increasingly hot microclimate, either of which might be the case if the clothing over the spine provides too much insulation or too little ventilation, then the spine overheats.

In the overheated state the spine will direct the brain in (i) above to develop a sluggish metabolism (including suppressed nervous activity and a sluggish immune system), the net result being less fuel-to-heat conversion and lowered heat output either in local areas of the body or in the body overall, with the potential risk of cellular damage due to low temperature and/or low blood flow, and, in (ii) above the nervous tissue of the spine, owing to excess temperature and/or blood flow in excess of requirements, may suffer cellular heat damage and/or fusing, much in the same manner as an overheated electrical wire.

A similar situation may also arise in other temperature sensitive sites. Such a situation is hereinafter defined as 'overheating'.

Indeed, the spine, being the brain's chief temperature sensor, appears to function in much the same way as a thermostat, and within the scope of this invention, is regarded as the key temperature sensitive region of the body.

The conclusion is that it is desirable to have clothing having sectors which specifically prevent the spine from overheating. Furthermore, it is one desirable object to provide clothing with at least a sector occupying substantially and substantially exclusively (as hereinafter defined) the spinal cord site (as hereinafter defined), where convenient to the garment construction.

The anatomical distribution of the body's natural clothing of muscle and/or bulky fatty tissue is characteristic to humans.

A second category of temperature sensitive sites are those which when a human being observes their naked body in a mirror, whether fat, thin, short or tall, it is noticeable how certain areas are seen to be padded with much less muscle and/or bulky fatty tissue than other areas. These areas not protected by fat pads include the spine, back of neck, back of knees, front of chest, below the breasts, the sacral dimples (hereinafter defined), armpits, front of elbows and groin and shins.

The general relative absence of fat pads in these areas appears to suggest that their insulatory requirements are less than for those areas which are generally relatively more protected/insulated by fat pads.

The conclusion is that it is desirable to have clothing that keeps the body warm and/or insulated whilst having sectors which are specifically less insulated in areas of relatively less fat pads.

A third category of temperature sensitive sites are those which tend to sweat more than other areas of the body. They can be observed by looking at the sweat pattern on the shirt of an athlete after a hard 'work-out', and they include the spine and all of the other areas not protected by fat pads.

Sweating is a major way in which the human body is able to lose heat to keep cool (in a warm or hot microclimate), by the latent heat of evaporation of sweat from the skin surface, and so control its temperature and metabolism.

The body is constantly raising its activity level and temperature in response to the germs and diseases which are attacking it 24 hours a day. Unless the skin can thermoregulate freely, the body will not be able to maintain the requisite temperature and activity level, and so the body may become infected and/or suffer cellular damage and/or DNA damage, which is likely to be inefficiently repaired.

The fact that the skin is characterized by areas which apparently sweat more than others would suggest their need to be able to lose heat and sweat properly in order to thermoregulate efficiently, specifically in order to maintain their temperature between those limits which are necessary for their functional demands at any particular time.

It is concluded that improved cellular activity of the body would be provided by clothing having sectors specifically in sweaty regions, thereby allowing the body to sweat effectively.

Indeed, it would appear to be a very important consideration that in these 'sweaty' areas can be found relatively higher concentrations of lymph glands (for temperature sensitive immune cell production) and/or lymph and/or nervous tissue (temperature sensitive tissue) and/or large blood vessels close to the surface of the skin. In particular the spine, back of the neck, front of the chest, armpits and groin.

The location of these glands and nervous tissue being close to the skin's surface, appears to suggest that these temperature sensitive sites need to be able to control their temperature between narrow limits and/or lose heat and sweat properly, in order to maintain their temperature between those limits which are necessary for their normal and/or optimum functioning.

Indeed, in the case of a person who is ill, it can be observed that lymph glands often swell up and come to the surface, where, (provided their microclimate allows) they will be better able to readily increase their metabolism (in an unsuppressed manner), to keep cool, and control their temperature, ie avoid overheating.

It is concluded that it is desirable to have clothing which incorporates sectors which provide for efficient thermoregulation, specifically in sites of high densities of lymph glands.

A particularly 'sweaty' area is the groin site, where reproductive glands are located close to the surface of the skin, where, provided their microclimate permits, they will be able to lose heat and sweat properly, in order to maintain, over 24 hours, their temperature between those limits which are necessary for their normal and/or optimum functioning. Indeed, the testicles (temperature sensitive sites of reproductive cell production), since they hang outside the body, are perfectly positioned to do this.

It is concluded that improved reproductive cell activity would be encouraged by clothing having specific sectors that allow reproductive tissues/organs to thermoregulate efficiently.

Current/conventional clothing (which is largely fashion orientated) does not provide for the thermoregulatory needs of the aforementioned temperature sensitive sites. As a result, those areas which are relatively less protected by 'fat pads', and which would therefore appear to require relatively less insulation than surrounding areas, may be defined as 'overinsulated', and may well overheat as a result, (causing all kinds of strain and/or problems for the body).

Furthermore, when overinsulated the aforementioned 'sweaty' areas, which need to be able to sweat easily, including those areas with glands and/or nervous tissue close to the skin's surface so that they can thermoregulate properly, may be prevented from doing so. In such an overheated microclimate these temperature sensitive sites may not have the flexibility to respond quickly enough to control their temperature, as appropriate, between those limits which are necessary for their normal and/or optimum functioning.

It is concluded that it is desirable to have sectors within clothing providing less insulation and/or more ventilation (as appropriate) in temperature sensitive sites, and furthermore, that such clothing will keep the body warmer by stimulating and raising metabolism, and allow rapid unsuppressed increases in metabolism, as required, either in local regions of the body or throughout the entire body, according to the demands placed upon the body.

II. Description of the Prior Art

Protective clothing, designed primarily for use in extreme climatic and other extreme and/or hazardous conditions, eg fire, radiation, seems to have little regard for the body's thermoregulatory requirements. This might normally be done by using ventilated fabrics, such as string vest or mesh material, and/or microporous waterproof fabrics eg laminated or coated fabrics, to aid loss of heat from body and evaporation of sweat. An example of such clothing might be climbing wear made from a microporous waterproof fabric.

In a sense all clothing may be described as protective, in that it provides the body with assistance against the elements.

However current protective clothing does not have regard to the thermoregulatory needs of the temperature sensitive sites, as distinct from surrounding areas. As a result of this non-discriminatory factor, both insulation and ventilation tend to be applied and/or provided uniformly over the entirety of the surface of the skin being protected by the garment, and not in accordance with the body's thermoregulatory requirements, which appear to require non-uniform ventilation and insulation over the body surface.

Furthermore, a common problem with such clothing is optimising a balance between various factors and/or functional requirements:

(a) Warmth; this may encourage the use of fabrics which efficiently trap air, such as fleece, pile, wool, or, in nylon wetsuit type garments, which efficiently trap a layer of water. These garments do not provide for an exchange of temperature (hereinafter defined as 'heat exchange') by having a low insulatory capacity specifically in temperature sensitive sites.

(b) Durability; here tough fibres such as tightly woven mesh or solid materials which are abrasion resistant and puncture-proof, are used to provide lasting quality with continued use. Such garments are generally heavy and/or bulky in construction.

(c) Protection; special fabrics which are heat and/or chemical and/or water resistant or proof, for example, for dealing with industrial waste (eg radiation or poisons) or 'storm suits' for use in extreme weather conditions. These garments are generally uncomfortable to wear.

(d) Breathability; to provide for heat loss and comfort either by having a ventilatory capacity to exchange air or moisture between the microclimate and the external climate (hereinafter defined as 'vapour exchange'). This is in contrast to common current designs wherein the fabric absorbs sweat from the skin surface before finally evaporating from the surface of the fabric, with the result that the skin is inefficiently cooled on account of a latent cooling of the fabric rather than the skin.

In optimising such a balance, one or more of these factors/functions may well be compromised. This may well result for example in a heavy, durable and uncomfortable, protective, bulky, but warm garment with overall but minimal breathability. Such a garment would result in an overall reduction of the body's ability to generate and/or lose heat and sweat efficiently and effectively, thereby putting the body's temperature sensitive sites under a great strain in direct proportion to the stresses exerted on the body whilst wearing such clothing.

SUMMARY OF THE INVENTION

It is intended to provide articles of clothing incorporating sectors providing for heat and/or vapour exchange different from that of the rest of the garment, these sectors being located specifically, substantially, and substantially exclusively in the aforementioned temperature sensitive sites. (A sector can be regarded for the purpose of the present invention as being located 'substantially' at a temperature sensitive site or sites provided it extends over a substantial proportion of the total area of the site or sites. Provided a sector extends substantially over a specific temperature sensitive site or sites and not over any other area except in so far as it might marginally encroach such other area, in such a minimal way so as to be regarded as immaterial, then the sector can be regarded for the purpose of the present invention as being located 'substantially exclusively' at a specific temperature sensitive site or sites).

It is intended that garments incorporating such sectors will be warmer, at least as durable and protective in the non-temperature sensitive sites, more comfortable, and, most importantly, will minimize any possible disturbances caused to the body's thermoregulation from overheating. ('Non temperature sensitive sites' are herein defined as those areas of the body not falling within the definition of 'temperature sensitive sites' as hereinbefore defined).

It is an object of the present invention to provide a means by which clothing may be made more effective in its role in assisting temperature regulation, by:

1. Providing increased heat exchange by means of reduced insulation (herein defined as 'lower insulatory capacity') of temperature sensitive sites—reducing insulation of temperature sensitive areas not protected by 'fat pads' —allowing for improved response to increase metabolism as required, and improved heat exchange by, for example, conduction and radiation to and from the surface of the skin, and/or
2. Providing for increased vapour exchange by means of specific ventilation of temperature sensitive areas (herein defined as 'increased ventilatory capacity')—allowing flexibility for rapid increases in heat generation owing to facility for improved vapour exchange eg the loss of excess heated air or humidity, by, for example, convection and evaporation of sweat from the surface of the skin.

The present invention provides means by which the incorporation of sectors providing for relatively higher heat and/or vapour exchange, specifically, substantially and substantially exclusively in the body's temperature sensitive sites, may be adopted, permitting increased local temperature sensitivity in those areas, and facilitating their adaptability to environmental temperature (wherein the aforementioned disadvantages of current clothing can be minimized and/or overcome).

There are three basic garment types/categories/classes; upper body garment eg a shirt, lower body garment eg trousers, skirt, and one piece garment eg dress, boiler suit, ladies swimming costume.

Furthermore the present invention provides a means by which the incorporation of sectors of relatively higher ventilatory capacity and/or relatively lower insulatory capacity, specifically, substantially, and substantially exclusively in any area or areas of the three aforementioned garment types, coinciding with the temperature sensitive sites, may be adopted.

In this way, there is provided increased local temperature sensitivity in the temperature sensitive sites, facilitating their adaptability to environmental temperature, while at the same time providing for increased insulation/protection etc. (ie the functions of so-called protective clothing) in other areas of the body, as appropriate, wherein the aforementioned disadvantages of current clothing can be minimized and/or overcome.

Embodiments of the invention may comprise any one or more combinations of the following features as herein defined:

1. TYPE OF SECTORS

The sectors may be of different types, and with regard to manufacture, fabric and/or shape will have different qualities; Three types are defined as follows:

(a) 'sector'—any shape having a continuous perimeter located within the garment eg a hole in each armpit site (as hereinafter defined), or a hole in the spinal cord site (as hereinafter defined).

(b) 'fabric sector'—sector of material of a garment modified by means during manufacturer eg cut, cut into strips or slits, perforated, patterned with holes or perforations, having holes, perforations, ovals and/or set of holes of Euclidean geometry, stamped out from sheets.

(c) 'panel sector'—a panel of material incorporated by attachment means during manufacture of the garment eg sewn on, stitched on, secured by zips, fasteners, buttons, studs, press-studs, clips, ties, straps, buckles, staples, glue, velcro. A panel might be pre-cut and then incorporated by attachment means during garment assembly.

2. NATURE OF SECTORS

Examples of means by which increased heat exchange and/or vapour exchange can be provided by a sector or sectors are; increasing size and/or number and/or shape of holes or perforations; chemically modifying sector to achieve desired level of heat exchange and/or ventilation; incorporating different types of fabric; having one or more layers in the non-temperature sensitive sites to create zone(s) of relatively higher insulation; having one or more layers in temperature sensitive sites to vary levels of heat and/or vapour exchange.

3. TEMPERATURE SENSITIVE SITES

These temperature sensitive sites are defined as follows:

(1) spine—extends along the center of the back covering the entire length and breadth of a chain of 29 vertebrae, from the uppermost vertebra (C1) in the center base of the skull to the lowermost vertebra (S4) in the central lower portion of the hips. Beginning with the uppermost vertebra and working downwards, the groups of vertebrae are as follows; the cervical or 'neck' vertebrae (C1–C7 inclusive), the thoracic or 'back' vertebrae (T1–T12 inclusive), the lumbar or 'small of the back' vertebrae (L1–LS inclusive) and, finally, the sacral or 'lower end of the hips' vertebrae (S1–S5 inclusive) (hereinafter defined as the 'spinal cord site'). (The lowermost portion of the spine itself is the coccygeal section of vertebrae (C1–C4 inclusive).

(2) front and back of the neck—where there is a relative absence of fat pads, and which is characterized by a relatively higher concentration of nervous tissue close to the skin surface, is hereinafter defined as the 'front and back of neck site';

(3) back of the knees—hereinafter defined as the 'back of knee site';

(4) front of the chest—where there is a relative absence of fat pads, and where there is a relatively higher concentration of nervous tissue close to the skin surface, is hereinafter defined as the 'front of chest site';

(5) below the breasts—this area located just below the breasts and not protected by fat pads, is hereinafter defined as 'the breast site';

(6) the armpits—areas not protected by fat pads, which sweat relatively more, and which have relatively higher concentrations of lymph glands close to the skin surface, are hereinafter defined as 'the armpit sites';

(7) front of elbows—hereinafter defined as 'front of elbow site';

(8) groin—area not protected by fat pads, which sweats relatively more, and which has reproductive tissues and/or organs and relatively higher concentrations of lymph glands close to the skin surface, is hereinafter defined as the 'groin site';

(9) knee and shins—areas not protected by fat pads hereinafter defined as 'shin sites'.

(10) 'sacrum dimples' —located at the top of the sacrum region hereinafter defined as the 'sacrum dimples site'.

4. SECTOR LOCATION

It is intended to provide means by which sectors of the garment of desired characteristic nature be located specifically, substantially and substantially exclusively (as hereinbefore defined) at any temperature sensitive site(s). Where two or more temperature sensitive sites coincide it may be desirable to manufacture a garment having a sector covering both/all of these sites.

5. SECTOR AREA OF GARMENT

It is desired to provide a means by which the sector shape occupies an area of the garment identical to the shape and configuration of a temperature sensitive site. The more close-fitting is the garment, the more accurately will the sector be able to follow the shape and configuration of the temperature sensitive site eg an elasticated fabric; the more loose-fitting is the garment, the less accurately will the sector be able to follow the shape and configuration of the temperature sensitive site eg a non elasticated fabric, but provided it extends over the site substantially and substantially exclusively (as hereinbefore defined), this is provided for within the scope of the present invention.

6. SECTOR MATERIAL

Influence of materials on 5 above specifically on the size of the sector area eg elasticated and ribbed materials will be able to cover more accurately a particular area. Influence of materials on heat and/or vapour exchange eg use of string vest material or mesh in temperature sensitive sites will entrap air when wearer is inactive/sedentary and thus provide insulation/warmth, and, when wearer engages in activity, large pores will provide for increased air movement/heat and/or increased vapour exchange thereby aiding thermoregulation of individual. Use of any other material which changes/alters and/or opens/loosens its structure in response to heat eg by adopting a more open weave. Different types of fabric with various properties may be used eg waterproof, airtight, pvc, nylon.

7. OUTLINE SHAPE OF SECTOR

Influence of manufacture on outline/perimeter/shape of sector. Difficulties of production of sector will depend on process of construction; eg a curved perimeter close to temperature sensitive site outline, will be more difficult to produce than straight-edged perimeter, which although easy to produce, reproduces less accurately the outline shape of a particular site.

Embodiments of the invention may comprise any one or more of the characteristics listed below incorporated in the following categories of articles of clothing as hereinafter defined:

1. UPPER BODY GARMENT

Types include:

cut-away sleeve cut-off top, cut-away sleeve, sleeveless, short sleeve, sleeve with collar, long sleeve, long sleeve with collar, long sleeve with hood;

Examples include:

sweatshirt, shirt, polo shirt, vest top, jacket, brassiere.

2. LOWER BODY GARMENT

Types include:

cut-away shorts, shorts, mid-length trousers, long trousers;

Examples include:

cycling shorts, underpants, jogging pants, jeans, trews.

3. ONE PIECE GARMENT

Types include one-piece versions of all those listed in upper body garment section;

Examples include:

swimming costume, jump suit, flying suit, leotard, boiler suit.

It is a central object of the present invention to provide means whereby a garment in its normal draped arrangement ('normal draped arrangement' of a garment is herein defined as the usual/normal positioning/appearance adopted by a garment when worn by a mannequin) extending over any or any specific area of the spinal cord site, incorporates in that area or specific area of the spinal cord site, a sector, which:

(1) in at least a substantial area of its uppermost region ('uppermost region' is herein defined as vertebrae C1–T12 inclusive) including at least the whole of the uppermost section or portion of this region, is of relatively lower insulatory capacity and/or of relatively higher ventilatory capacity; and (2) in at least a substantial area of its lowermost region ('lowermost region' is herein defined as vertebrae L1–S5 inclusive) including at least the whole of the lowermost section or portion of this region, is of relatively lower insulatory capacity and/or of relatively higher ventilatory capacity.

It is a further object of the present invention to provide means whereby a garment in its normal draped arrangement extending over any area of the body, being an area where one or more of the various types of temperature sensitive sites (areas which sweat relatively more, areas with relatively higher concentrations of lymph and/or reproductive glands close to the skin surface, areas with relatively higher concentrations of lymph and/or nervous tissue close to the skin surface, and areas with large blood vessels close to the skin surface) coincide, incorporates in that area a sector which in at least a substantial portion of that area, is of relatively lower insulatory capacity and/or relatively higher ventilatory capacity.

According to the present invention, there is provided an article of clothing which, in its normally draped arrangement, incorporates one or more sectors of relatively lower insulatory capacity (as hereinbefore defined) and/or relatively higher ventilatory capacity (as hereinbefore defined) in a substantial area or areas of the garment being substantially exclusively in one or more temperature sensitive sites (as hereinbefore defined) including sector(s) of fabric (as hereinbefore defined) in any area or specific area of the spinal cord site (as hereinbefore defined) over which the garment extends being of relatively lower insulatory capacity and/or relatively higher ventilatory capacity in:

(1) at least a substantial area of the uppermost region of the sector(s) including at least the whole of the uppermost section or portion of this region. and (2) at least a substantial area of the lowermost region of the sector(s) including at least the whole of the lowermost section or portion of this region.

BRIEF DESCRIPTION OF THE DRAWINGS

The present invention is illustrated by way of example in the accompanying drawings wherein.

Preferred embodiments of the invention may comprise any one or more of the following features or combinations of sectors with reference to the accompanying diagrams:

FIGS. 5*a* to 5*i* illustrate possible front views of a series of upper body clothing garments incorporating possible combinations of sector panels;

FIGS. 6*a* to 6*i* illustrate possible back views of a series of upper body clothing garments incorporating possible combinations of sector panels;

FIGS. 7*a* to 7*g* illustrate possible front views of a series of lower body clothing garments incorporating possible combination of sector panels.

FIGS. 8*a* to 8*e* illustrate possible back views of a series of lower body clothing garments incorporating possible combinations of sector panels.

Figure 9:
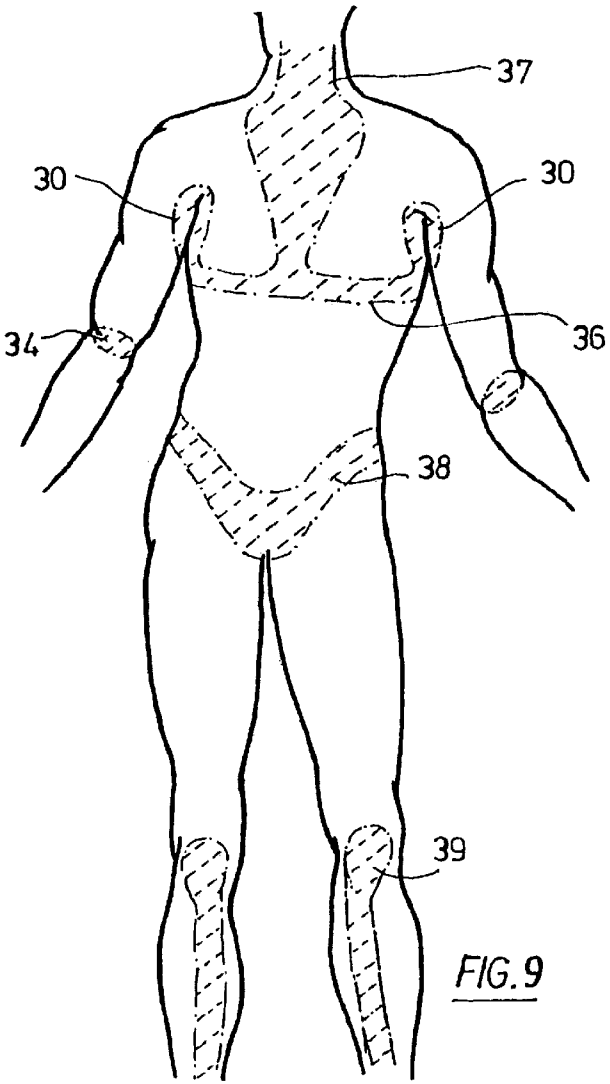

FIG. 9 illustrates a possible front view of a one-piece garment incorporating possible sectors and combinations thereof.

Figure 10:
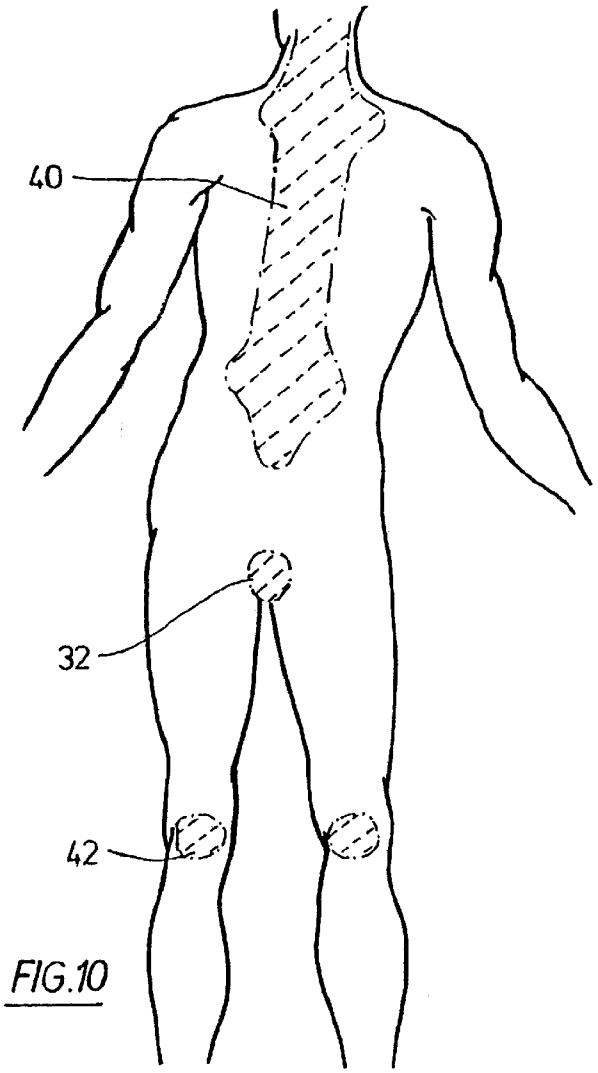

FIG. 10 illustrates a possible back view of a one-piece garment incorporating possible section and combinations of sectors.

FIG. 11 illustrates a single layer of thin breathable fabric 43.

FIG. 12 illustrates a medium thick layer of breathable fabric 44.

FIG. 13 illustrates a double medium thick layer of breathable fabric 44*a*.

FIG. 14 illustrates a possible back view of a garment for example a sweatshirt.

FIG. 15 illustrates a possible front view of a garment for example a sweatshirt.

Figure 16C:
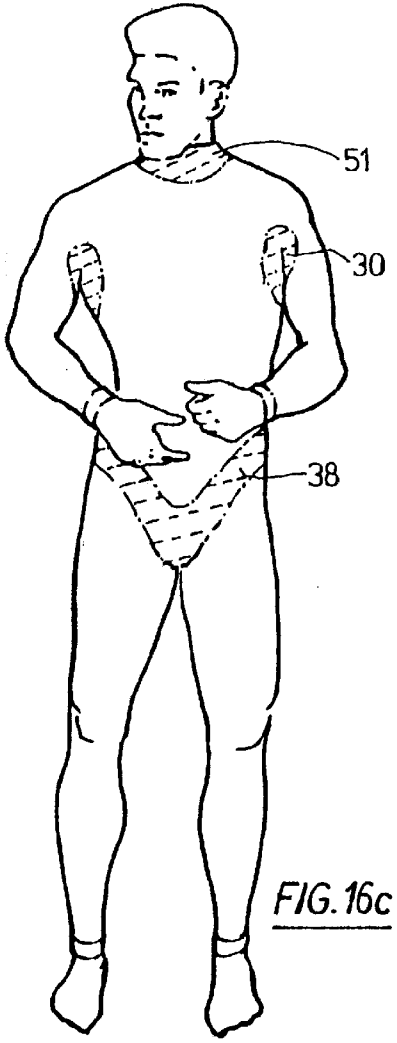
Figure 16B:
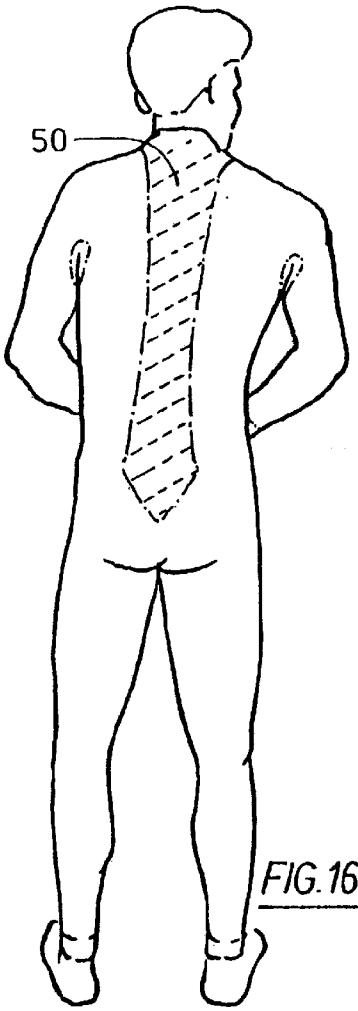
Figure 16A:
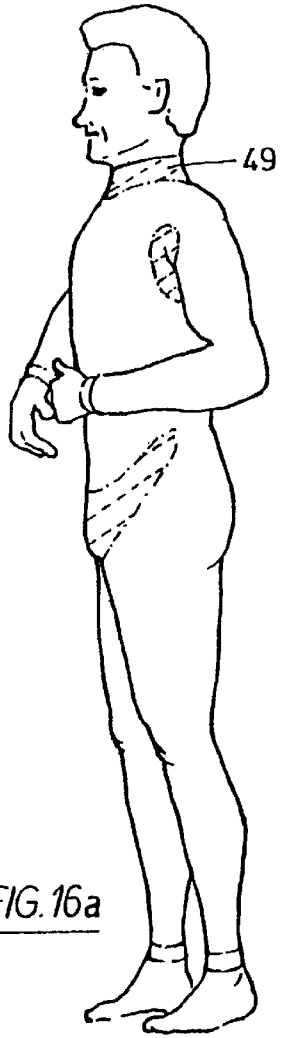

FIGS. 16*a* to 16*c* illustrate a possible one-piece garment, for example a wetsuit or drysuit.

DESCRIPTION OF THE PREFERRED EMBODIMENT

Figures 1, 2:
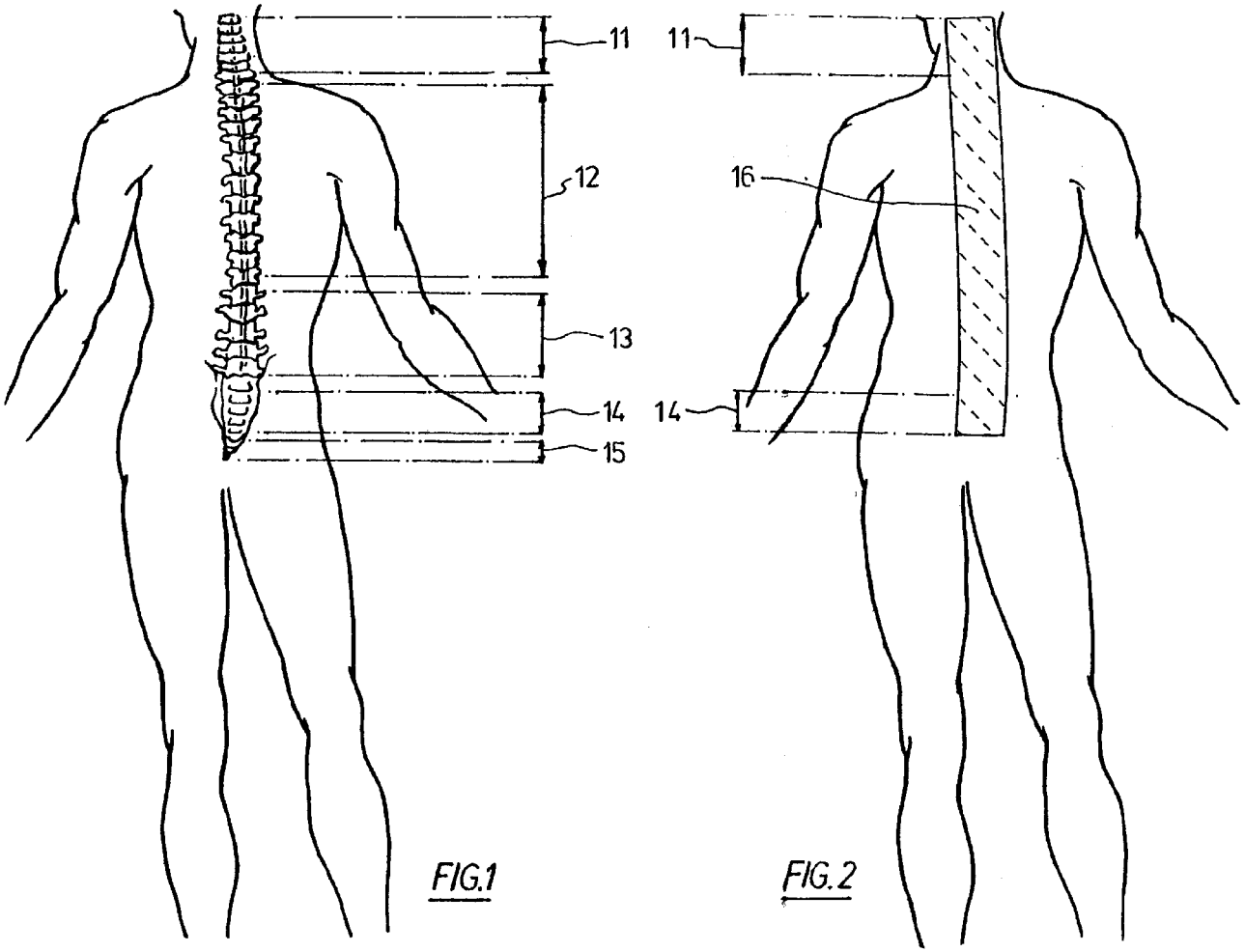
FIG. 1 is a back view of a human being illustrating the various sections of the spine.
FIG. 2 is a back view of a human being illustrating the temperature sensitive spinal cord site as hereinbefore defined.

Referring to FIG. 1, the drawing illustrates the arrangement of the 29 vertebrae into groups; 11 represents the cervical region of the spine—C1–C7 inclusive; 12 represents the thoracic region—T1–T12 inclusive; 13 illustrates the lumbar region—L1–L5 inclusive; 14 illustrates the sacral region—S1–S5 inclusive; 14 and 15 illustrate the coccygeal region, 14 being C1, and 15 being C2–4 which are commonly fused.

Referring to FIG. 2, the drawing illustrates the various sections comprising the spinal cord site; 11 represents the cervical region (C1–C7 incl.); 16 illustrates both the thoracic (T1–T12 incl.) and the lumbar regions (L1–L5 incl); 14 represents the sacral region and upper portion only of the coccygeal region (C1 only).

Figure 3:
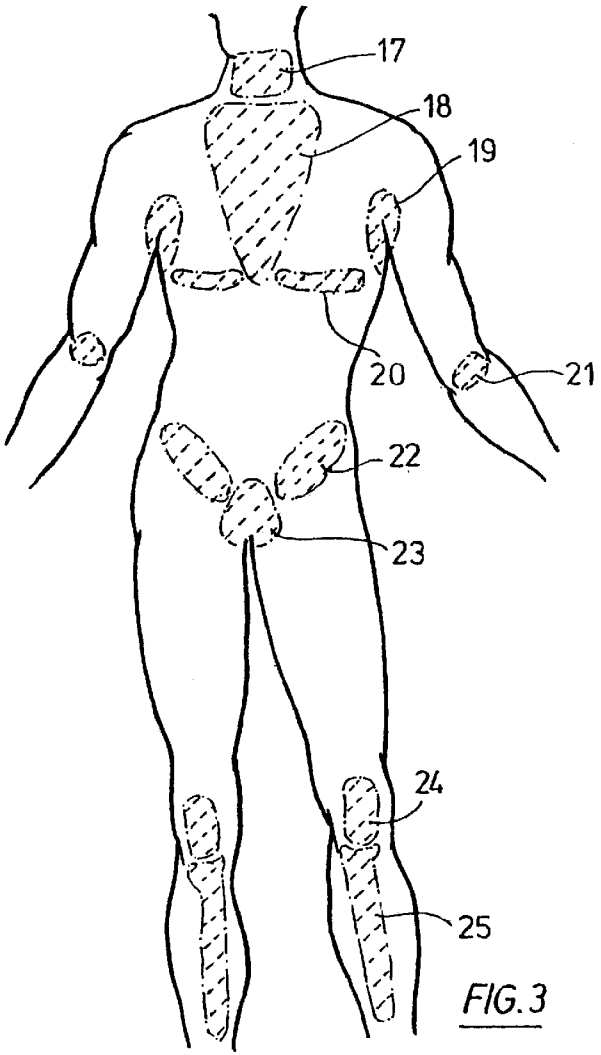
FIG. 3 is a front view of a human being illustrating the temperature sensitive sites as hereinbefore defined.

Referring to FIG. 3, 17 depicts the front portion of the 'front and back of neck site' as hereinbefore defined; 18 depicts the 'front of chest site' as hereinbefore defined; 19 depicts 'the armpit site' as hereinbefore defined; 20 depicts 'the breast site' as hereinbefore defined; 21 depicts 'the front of elbow site' as hereinbefore defined; 22 and 23 depict the 'groin site' as hereinbefore defined; 24 and 25 depict the 'knee and shin site' as hereinbefore defined.

Figure 4:
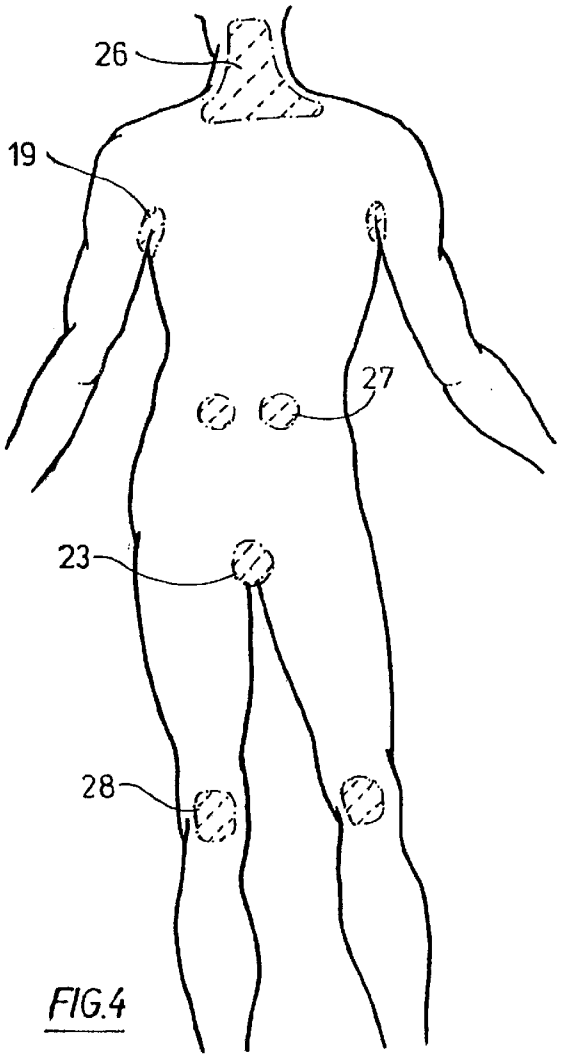
FIG. 4 is a back view of a human being illustrating the temperature sensitive sites as hereinbefore defined.

Referring to FIG. 4, 26 depicts the back portion of the 'front and back of neck site' as hereinbefore defined; 19 depicts 'the armpit sites' as hereinbefore defined; 27 depicts the 'sacrum dimples site' as hereinbefore defined; 23 depicts the lower portion of the 'groin site' as hereinbefore defined; 28 depicts the 'back of knee site' as hereinbefore defined.

Figures 5A, 5B, 5C, 5D, 5E, 5F, 5G, 5H, 5I, 6A, 6B, 6C, 6D, 6E, 6F, 6G, 6H, 6I:
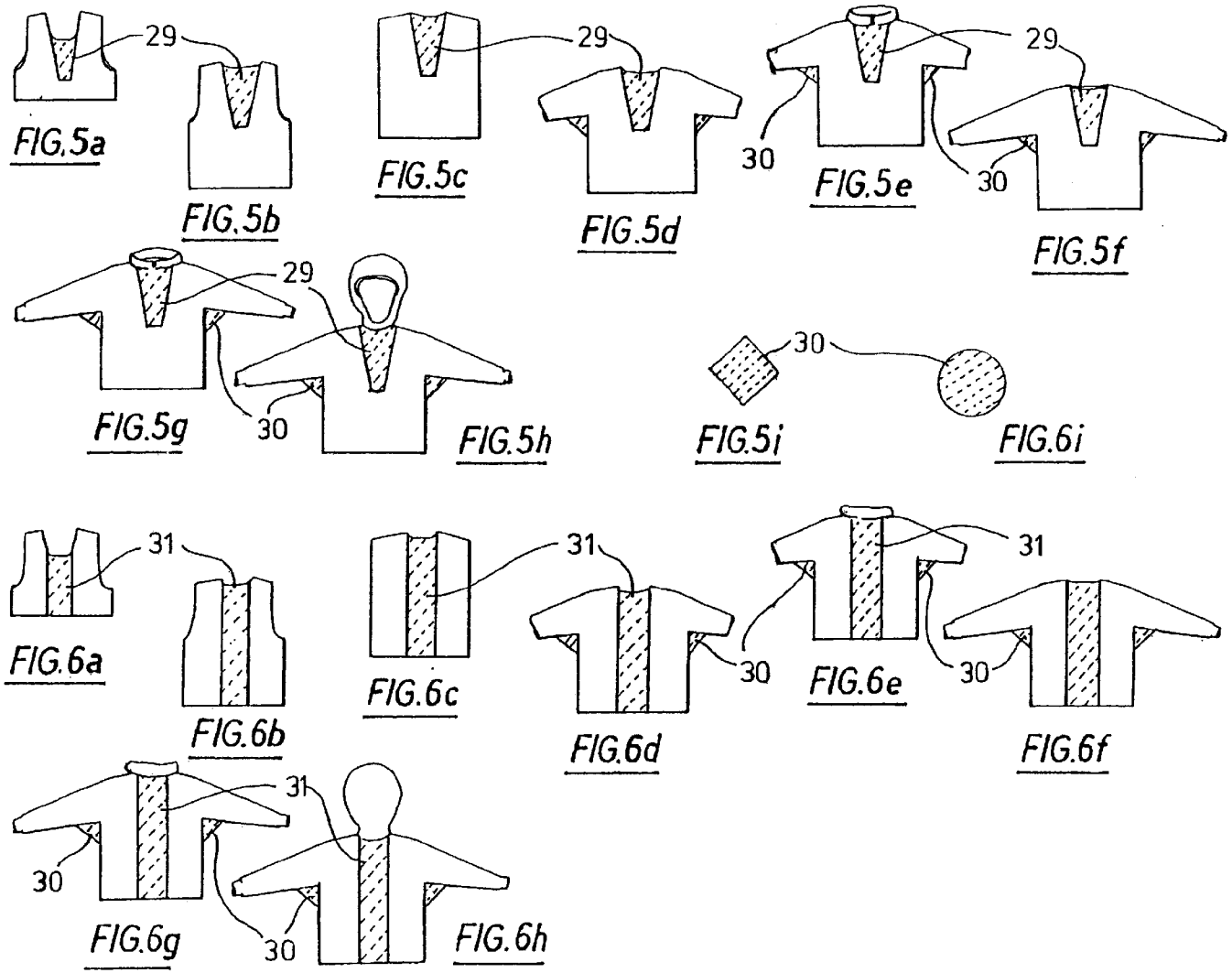

Referring to FIG. 5, FIG. 5*a* cut-away sleeve cut-off top, FIG. 5*b* cut-away sleeve, FIG. 5*c* sleeveless, FIG. 5*d* short sleeve, FIG. 5*e* sleeve with collar, FIG. 5*f* long sleeve, FIG. 5*g* long sleeve with collar, FIG. 5*h* long sleeve with hood;

Examples include:

sweatshirt FIG. 5*f*, shirt FIG. 5*g*, polo shirt, FIG. 5*e*, vest top/athletic vest FIG. 5*b*, FIG. 5*g* football/rugby shirt, FIG. 5*h* windcheater, jacket FIG. 5*h*, brassiere FIG. 5*a*, body warmer 5*c*, T-shirt 5*d;*

29 depicts front of chest sectors; 30 depicts armpit sectors. FIGS. 5*i* and 6*i* illustrate possible shapes for armpit sectors.

Referring to FIG. 6, FIG. 6*a* cut-away sleeve cut-off top, FIG. 6*b* cut-away sleeve, FIG. 6*c* sleeveless, FIG. 6*d* short sleeve, FIG. 6*e* sleeve with collar, FIG. 6*f* long sleeve, FIG. 6*g* long sleeve with collar, FIG. 6*h* long sleeve with hood;

Examples include:

sweatshirt FIG. 6*f*, shirt FIG. 6*g*, polo shirt FIG. 6*e*, vest top FIG. 6*b*, jacket FIG. 6*h*, brassiere FIG. 6*a*, body warmer 6*c*, T-shirt 6*d;*

30 depicts armpit sectors; 31 depicts spine sectors. Figs 5*i* and FIG. 6*i* illustrate examples of possible shapes for armpit sectors.

Referring to FIG. 7, FIG. 7*a* cut-away shorts, FIG. 7*b* shorts, FIG. 7*c* mid-length trousers, FIG. 7*d* long trousers, FIG. 7*e* skirt;

Examples include:

FIG. 7*c* cycling shorts, FIG. 7*a* underpants, FIG. 7*d* jogging pants, FIG. 7*d* jeans, FIG. 7*d* trews, FIG. 7b shorts;

depicts groin sectors. FIGS. 7*f* and 7*g* illustrate possible shapes for groin sectors.

Referring to FIG. 8, FIG. 8*a* cut-away shorts, FIG. 8*b* shorts, FIG. 8*c* mid-length trousers, FIG. 8*d* long trousers, FIG. 8*e* skirt;

Examples include:

FIG. 8*c* cycling shorts, FIG. 8*a* underpants, FIG. 8*d* jogging pants, FIG. 8*d* jeans, FIG. 8*d* trews, FIG. 8*b* shorts;

32 depicts groin sectors. FIGS. 7*f* and 7*g* illustrate possible shapes for groin sectors. 33 depicts spine sectors.

Referring to FIGS. 5 and 6, wherein they are joined by attachment means in any combination to form a one-piece suit, it will be appreciated that as such the following examples would be possible.

Examples include:

FIG. 5*b* and FIG. 6*b* with FIG. 7*a* and FIG. 8*a* swimming costume, FIG. 5*g* and FIG. 6*g* with FIG. 7*d* and FIG. 8*d* jump suit/skisuit, FIG. 5*h* and FIG. 6*h* with FIG. 7*d* and FIG. 8*d* waterproof suit eg wetsuit, FIG. 5*d* and FIG. 6*d* with FIG. 7*e* and FIG. 8*e* dress;

Referring to FIG. 9, 37 illustrates a possible front of neck and front of chest sector; 36 illustrates a possible breast site sector; 34 illustrates a possible front of elbow site sector; 38 illustrates a possible groin and lower groin sector; 39 illustrates a possible knee and shin sites sector.

Referring to FIG. 10, 40 illustrates a possible back of neck site, spinal cord site and sacrum dimples site sector; 32 illustrates a lower groin site sector; 42 illustrates a back of knee site sector.

Referring to FIGS. 11 to 15 inclusive; 29 indicates a front of chest sector (having low insulatory capacity as per FIG. 11): 30 & 43 indicates armpit sectors (having low insulatory capacity as per FIG. 11): 44 indicates a sector of material for covering the arm (having medium insulatory capacity as per FIG. 12); 44*a* indicates a sector of material for covering the upper body (having high insulatory capacity as per FIG. 13); 45 indicates outflow of warm air; 45*a* indicates restricted outflow of warm air; 45*b* indicates very restricted outflow of warm air; 46 indicates inflow of cool air; 46*a* indicates restricted inflow of cool air; 46*b* indicates very restricted inflow of cool air; 47*a* indicates outflow of vapour; 47*a* indicates restricted outflow of vapour; 47*b* indicates very restricted outflow of vapour. 48 illustrates a possible back of neck site and spinal sector.

Referring to FIG. 16, 16*a* illustrates a possible side view, showing possible front and back of neck sector 49; 16*b* illustrates a possible back view, showing possible back of neck and spine sector 50; 16*c* illustrates a possible front view, showing a possible front of neck sector 51.

It is not intended to limit the invention to the above example only, many variations of clothing being possible without departing from the scope of the invention.

What is claimed is:

1. An article of clothing for covering at least a part of a wearer's body having temperature sensitive bodily regions of high thermoregulatory capacity, including a spinal cord site, and bodily regions of lower thermoregulatory capacity, the article of clothing including fixed or removable air permeable or impermeable sectors including at least one sector of low heat insulatory capacity (29, 30, 31; 32, 33; 43, 48; 38, 49, 50, 51) and at least one sector of higher heat insulatory capacity (44; 44*a*; 52) wherein the article of clothing is constructed such that substantially al of the sectors of low heat insulatory capacity at sections of the article which are adapted to be aligned substantially exclusively with a specifically defined bodily region of high thermoregulatory capacity (15, 16, 17, 18, 19, 20, 21, 22, 23, 24, 25, 26, 27, 28) and such that the or each sector has a continuous perimeter and includes at least a hole, a modified fabric, or a panel of substantially constant low insulatory capacity value of substantially permanent dimensions (31, 33, 40, 48, 50) at a section of the article which is adapted to be aligned substantially exclusively with a region of the spinal cord site (11, 12, 13, 14, 15) overlayed by the article, and said hole, modified fabric, or panel being provided in a substantial majority of said section aligned with the spinal cord site, being substantially exclusively in juxtaposition to the spinal cord site, and being provided in an insulatory surface area central to a back of the article of clothing which forms a minority of an overall insulatory surface area of the back of the article of clothing.

2. An article of clothing according to claim 1 wherein at least one sector of low insulatory capacity is included in the form of a panel of low insulatory capacity material sewn into the article.

3. An article of clothing according to claim 1 or claim 2 wherein at least one sector of low insulatory capacity is shaped as an elongate vertical column substantially similarly to an exclusive outline of the region of the spinal cord site.

4. An article of clothing according to claim 1 or 2 wherein the or each sector of substantially constant low insulatory capacity value also includes means for providing heat exchange by means of increase ventilatory capacity including perforations constructed in a monolayer of fabric, said perforations exposing the wearers skin directly to the external climate.

5. An article of clothing according to claim 1 or 2 wherein the or each sector of substantially constant low insulatory capacity value is waterproof.

6. An article of clothing according to claim 1 or 2 wherein the temperature-sensitive site includes an armpit and/or groin site of the wearer's body.

7. An article of clothing according to claim 1 or 2 wherein the or each temperature-sensitive site includes one or more regions of the wearer's body associated with localizations of tissue from the group consisting of nervous tissue, lymph glands, localized blood flow, sweat gland activity, reproductive tissue, spinal cord tissue, and/or animal fat, the article adapted to include at least one relatively V-shaped continuous sector in a minority insulatory surface area section central to the back and/or front of said article of clothing.

8. An article of clothing according to claim 1 or 2 wherein the or each sector of higher insulatory capacity has one or more layers functionally adapted for covering and thereby increasing insulatory capacity, by means of increased air trapping, in at least a part of a non-temperature-sensitive area of the body.

9. An article of clothing according to claim 1 or 2 wherein the or each sector of low insulatory capacity comprises a temperature-sensitive material whose temperature-sensitive structure changes, to provide greater heat exchange due to the material's response to heat.

10. An article of clothing adapted to cover a wearer's body, the article including at least one continuous perimeter sector of low heat insulatory capacity (29, 30, 31; 32, 33; 43, 48; 38, 49, 50, 51), and at least one sector of higher heat insulatory capacity (44; 44*a*; 52), wherein substantially all of the continuous perimeter sectors of low heat insulating capacity include at least a hole, a modified fabric or a panel arranged to be aligned specifically substantially exclusively with a body region (30, 32, 34, 36, 37, 39, 40, 42) having a high thermoregulatory capacity, wherein the article is structured specifically, by means of improved temperature control, for increasing the whole body's resistance to disease, or for stimulating and raising whole body metabolism, or to improve thermoregulatory control of the spinal nerves and/or the wearer's whole body, or for reducing local cellular damage and/or DNA damage, or for specifically improving reproductive cell functional activity, wherein the article includes a sector of substantially constant low heat insulating capacity value aligned substantially in juxtaposition to a collar and/or waistband and occupies a central back of the article to a width substantially equal to or less than a width of the collar, and a length of the sector occupies substantially a length of the article in juxtaposition to the spinal cord of the wearer.

11. A clothing ensemble including an article of clothing to cover an upper part of a wearer and an article of clothing to cover a lower part of the body, the articles of clothing either permanently or removably attachable to each other, the upper body clothing including at least one continuous perimeter sector of substantially constant low heat insulator capacity value (29, 30, 31; 43, 48; 49, 50, 51), and at least one sector of higher heat insulatory capacity (44; 44*a*; 52), wherein substantially all of the continuous perimeter sectors of low heat insulating capacity include at least a hole, a modified fabric or a panel arranged to be aligned specifically substantially exclusively with a body region (15–21 & 26) having a high thermoregulatory capacity and the lower body clothing including at least one continuous perimeter sector of substantially constant low heat insulatory capacity value (32, 33; 38, 49, 50, 51), and at least one sector of higher heat insulatory capacity (52), wherein substantially all of the continuous perimeter sectors of low heat insulating capacity include at least a hole, a modified fabric or a panel arranged to be aligned specifically substantially exclusively with a body region (22–25, 27 & 28) having a high thermoregulatory capacity.

12. A clothing ensemble as claimed in claim 11 further including at least one further outerlayer of upper or lower body clothing including one continuous perimeter sector of low heat insulatory capacity (29, 30, 31; 32, 33; 43,48; 38, 49, 50, 51), and at least one sector of higher heat insulators capacity (44; 44*a*; 52), wherein substantially all of the continuous perimeter sectors of low heat insulating capacity include at least a hole, a modified fabric or a panel arranged to be aligned specifically substantially exclusively with a body region (17–28 & 30, 32, 34, 36, 37, 39, 40, 42) having a high thermoregulatory capacity.

* * * * *